US005145162A

United States Patent [19]

Lachapelle et al.

[11] Patent Number: 5,145,162

[45] Date of Patent: Sep. 8, 1992

[54] BLANK DISPENSING APPARATUS HAVING OPPOSITELY ROTATING SEPARATOR ELEMENTS AND METHOD FOR USE

[75] Inventors: Philip S. Lachapelle, Tega Cay; Ralph S. Goldstein, Lake Wylie, both of S.C.

[73] Assignee: Roberts Systems, Inc., Charlotte, N.C.

[21] Appl. No.: 788,535

[22] Filed: Nov. 6, 1991

[51] Int. Cl.[5] ..... B65H 3/52

[52] U.S. Cl. ..... 271/119; 271/120; 271/122

[58] Field of Search ..... 271/118-123, 271/125

[56] References Cited

U.S. PATENT DOCUMENTS

| | | | |
|---|---|---|---|
| 3,857,559 | 12/1974 | McInerny | 271/122 |
| 3,888,479 | 6/1975 | Eder et al. | 271/119 |
| 3,970,298 | 7/1976 | Irvine et al. | 271/122 |
| 4,443,006 | 4/1984 | Hasegawa | 271/119 |
| 4,779,861 | 10/1988 | Ozawa et al. | 271/122 |
| 4,930,764 | 6/1990 | Holbrook et al. | 271/119 |
| 4,993,587 | 2/1991 | Abe | 271/122 |

FOREIGN PATENT DOCUMENTS

| | | | |
|---|---|---|---|
| 82253 | 4/1988 | Japan | 271/122 |

OTHER PUBLICATIONS

Falcone, V. J. "Document Separator", *IBM Technical Disclosure Bulletin*, vol. 4, No. 4, p. 1 (Sep. 1961).

*Primary Examiner*—Robert P. Olszewski
*Assistant Examiner*—Steven M. Reiss
*Attorney, Agent, or Firm*—Bailey & Hardaway

[57] ABSTRACT

An apparatus for the feeding of individual carton blanks from a stack of blanks held in a retaining magazine to an adjacent takeaway belt of a conveyor. A bi-directional roller of two or more wheels is provided whereby a cleat attached to the rim of one wheel is used to bias a package blank to an adjacent carton blank conveyor. A second wheel of the roller rotates in the opposite direction of the first wheel which engages and supports the remaining blanks.

9 Claims, 7 Drawing Sheets

BLANK DISPENSING APPARATUS HAVING OPPOSITELY ROTATING SEPARATOR ELEMENTS AND METHOD FOR USE

BACKGROUND OF THE INVENTION

The present invention relates to an apparatus for the withdrawal of individual carton blanks from a magazine stack and conveying them to an adjacent conveyor.

Recent developments in handled packages has allowed for the high speed mating of bayonet handles with a carton blank. The bayonet handle package, described in pending U.S. patent application Ser. No. 07/566,159, filed Aug. 9, 1990, and incorporated herein by reference, and a continuous motion package assembling apparatus, described in pending U.S. Pat. No. 5,095,638 patented Mar. 17, 1992, and incorporated herein by reference, portray the rapid evolution within the packaging field. The above-referenced assembling apparatus and bayonet handle package allow rapid insertion of handles during the assembly of cartons.

To keep pace with the current technology, it has been necessary to increase the supply rate of carton blank stock to the machines referenced above. Apparatuses of the prior art are unable to supply carton blank stock in a rapid and synchronized fashion to keep up with capabilities of the new packaging technology.

An apparatus of this type is known from U.S. Pat. No. 4,369,961 which uses conveyor belts driven by an eccentric roll and a shaft drive to propel the carton blanks to an adjacent conveyor. However, with such an arrangement, as the speed of the conveyor belt increases so does the contact force and withdrawal power of the belts. For high speed, repetitive operations, the contact forces and withdrawal power reach excessive levels resulting in slippage, fouling, excessive belt wear and damaged blanks, all of which result in costly production stoppage.

SUMMARY OF THE INVENTION

It is the object of this invention to provide an apparatus which overcomes the limitations of the prior art and allows high speed processing of carton blanks while minimizing production delays attributed to slippage, fouling, belt wear and carton blank damage.

It is a further and more particular object of this invention to provide a high speed carton feeder which is compatible with numerous sizes, weights and finishes of available carton blank stock.

It is still a further and more particular object of this invention to provide an apparatus which provides long wearing biasing means for feeding carton blanks to a carton blank conveyor.

It is still a further object of this invention to provide an apparatus with adjustable biasing means for accommodating a variety of carton blank stock.

In accordance with this invention, these objects are accomplished by providing a bi-directional multiple wheeled roller beneath a stack of carton blanks. The multiple wheeled roller has a cleat carried on one roller wheel to lift the carton stacks while simultaneously engaging and biasing the lower most blank to an adjacent carton blank conveyor. As the cleat disengages from the biased blank, the remaining stack of blanks is thereby lowered onto a second smooth surfaced wheel of the roller which rotates the direction opposite that of the cleated wheel. The smooth surfaced wheel thus engages the next blank providing both support and a frictional force which prevents the premature biasing of the second blank toward the conveyor.

It is preferable that the adjacent conveyor system be in synchronized drive with the cleat wheel of the blank feeder. A 90° gear box can be used to provide the necessary synchronization. Belt means connecting the cleated wheel axle to a reverse rotation gear box can be used to provide the counter rotation to the adjacent smooth surfaced wheel.

The multiple wheeled roller is best positioned near the end of the carton blank stack distal to the conveyor system. The magazine stack is inclined with the lower end adjacent to the conveyor so that the higher end of the carton blank engages the roller wheels. This arrangement facilitates the feeding of the lower blank edge to the conveyor system. The elevated distal end of the blank stock is supported by the multiple wheeled roller, the respective roller wheels providing a firm biasing and securing means.

DETAILED DESCRIPTION

In accordance with this invention, it has been found that a novel apparatus and method may be provided to facilitate the high speed feeding of carton blanks to a carton blank conveyor. The apparatus provides a bidirectional roller with a cleated wheel to lift and feed an individual carton blank on a stack of cartons to an adjacent carton blank conveyor, while an adjacent oppositely rotating wheel secures the sequential carton blank of the magazine stack.

Figure 1:
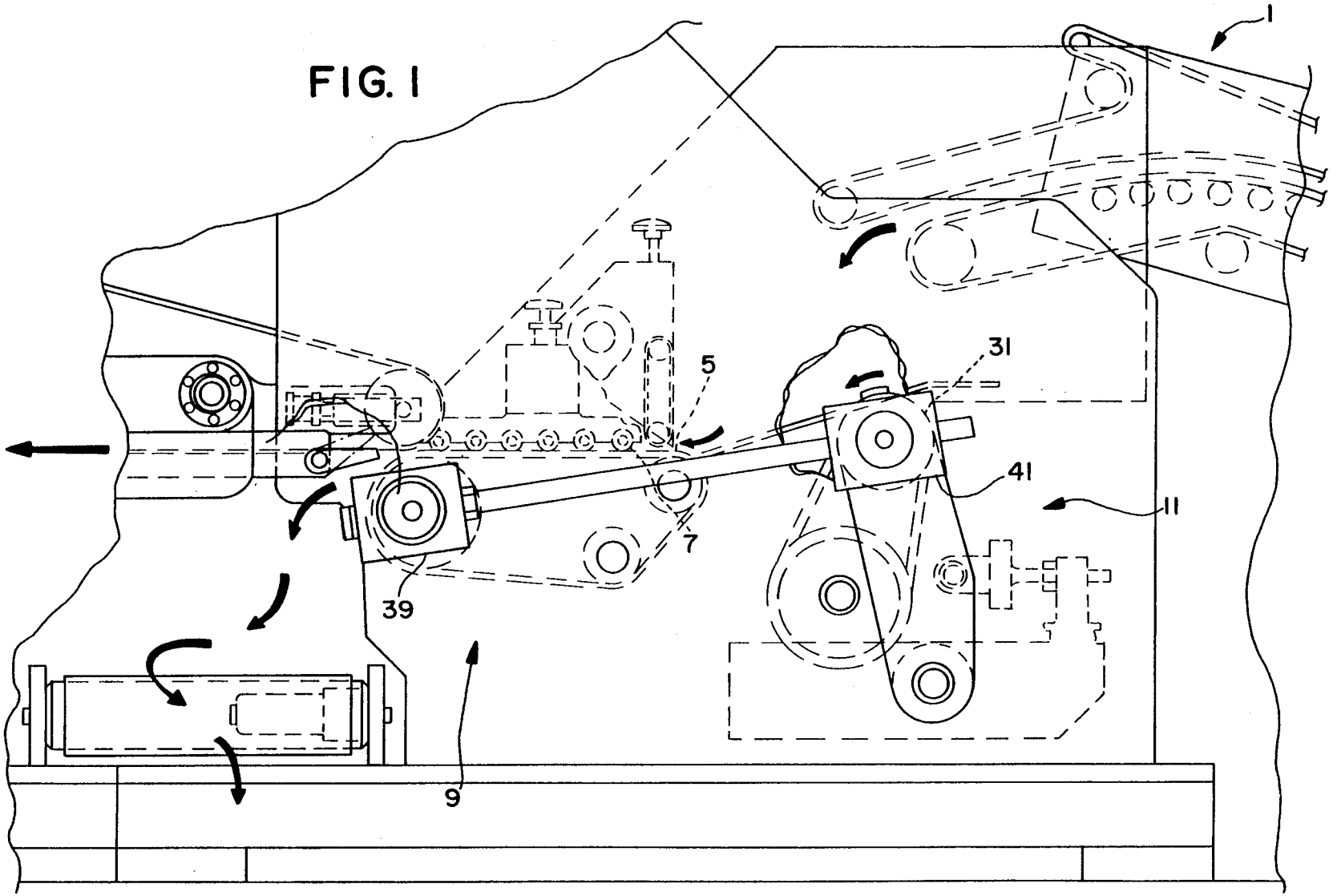
FIG. 1 is a side elevation partially in phantom of an embodiment of the apparatus for dispensing flat carton blanks to a conveyor shown in relative position to a carton blank pre-feeder and an adjacent conveyor.

As seen in FIG. 1, directional arrows indicate the general path of carton blanks (not shown) from a pre-feeder 1 to the dispensing apparatus 11 which inserts the blanks into a feeding belt 5 and nip rollers 7 of the adjacent conveyor 9.

Figure 2:
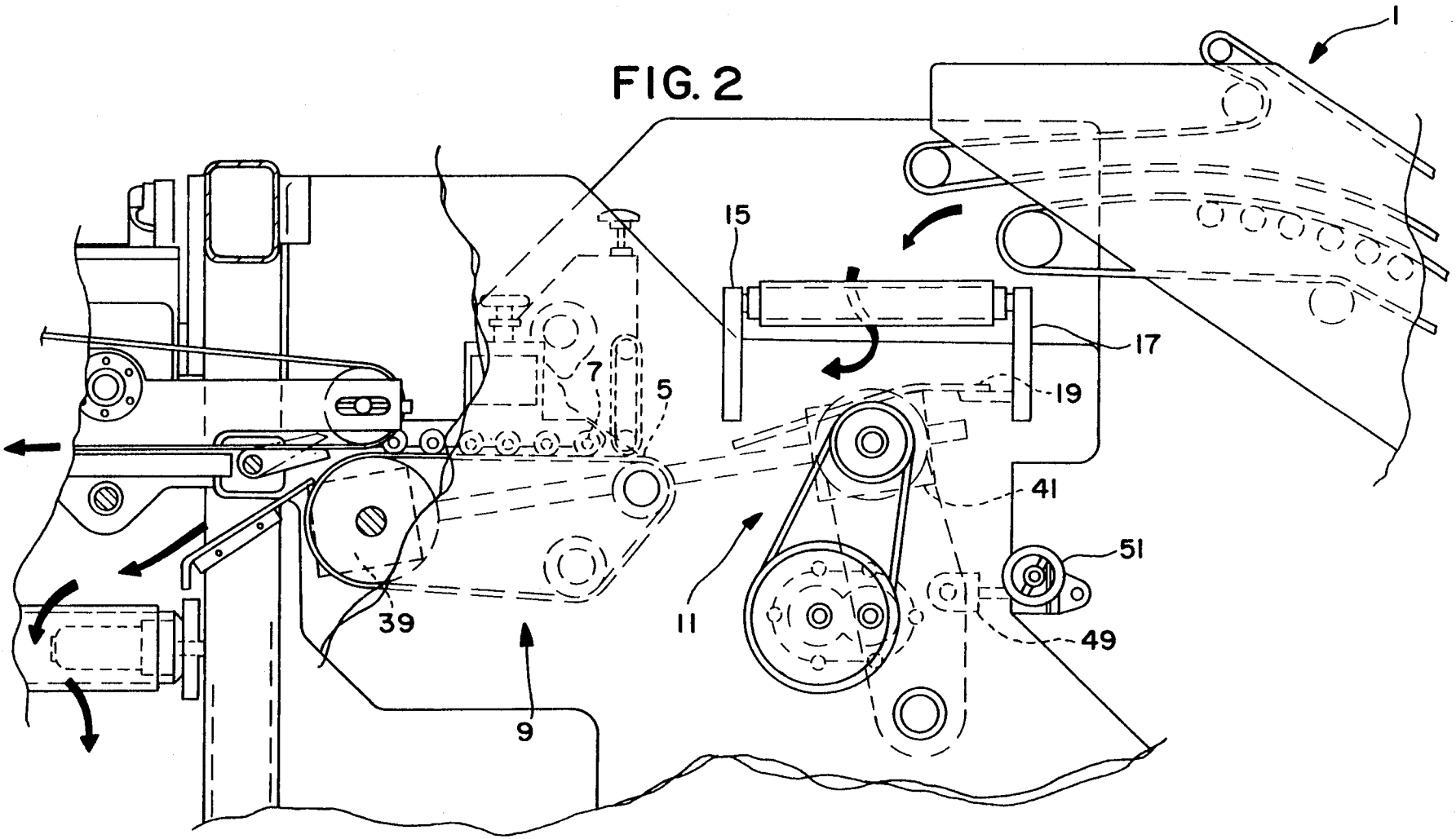
FIG. 2 is a side elevation similar to FIG. 1 of an embodiment of the claimed invention showing blanks being delivered to the dispensing apparatus with additional internal features shown in phantom.
Figure 3:
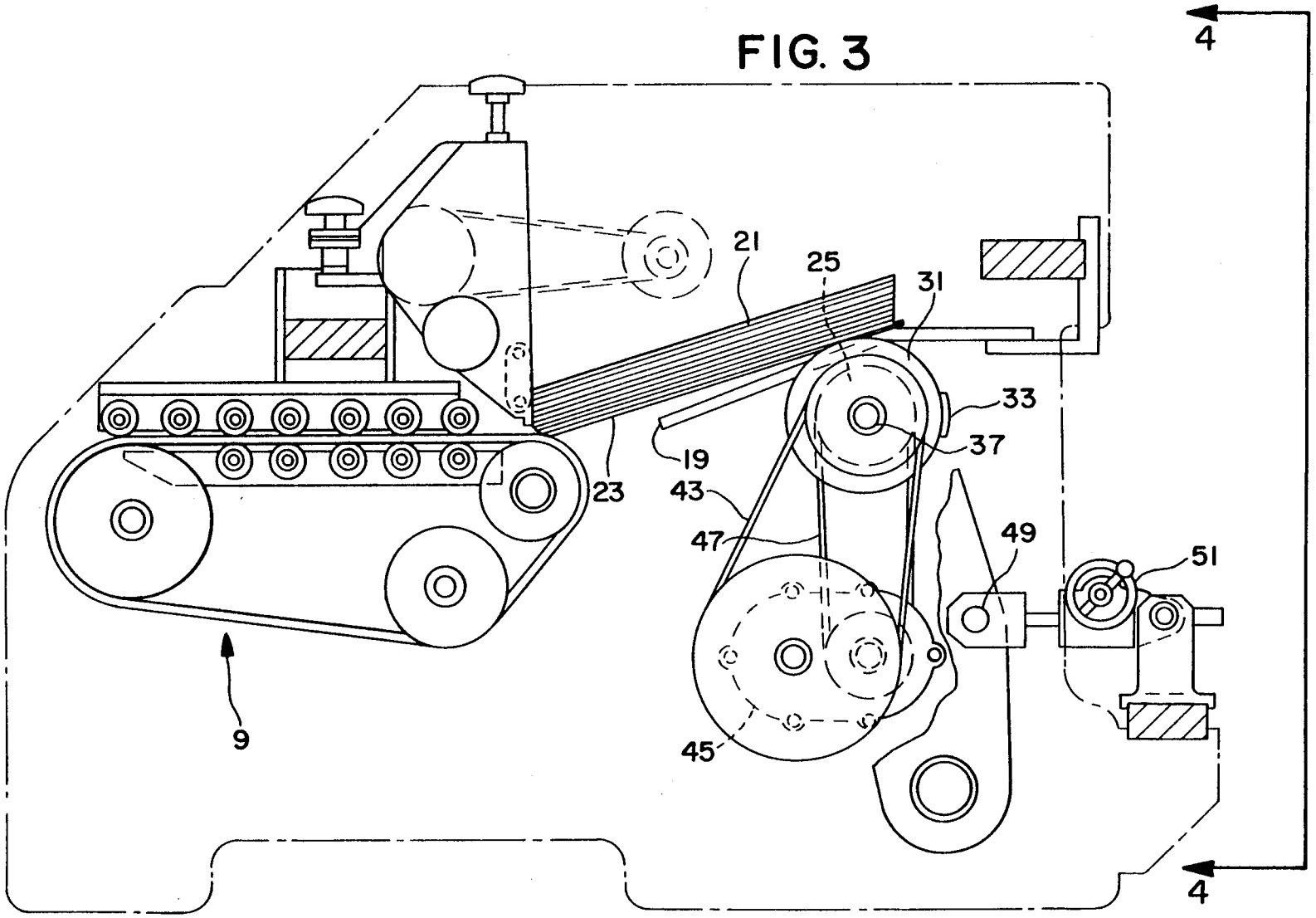
FIG. 3 is an enlarged elevation view of the blank dispensing apparatus and conveyor seen in FIGS. 1 and 2 carrying a supply of blank stock.
Figure 8:
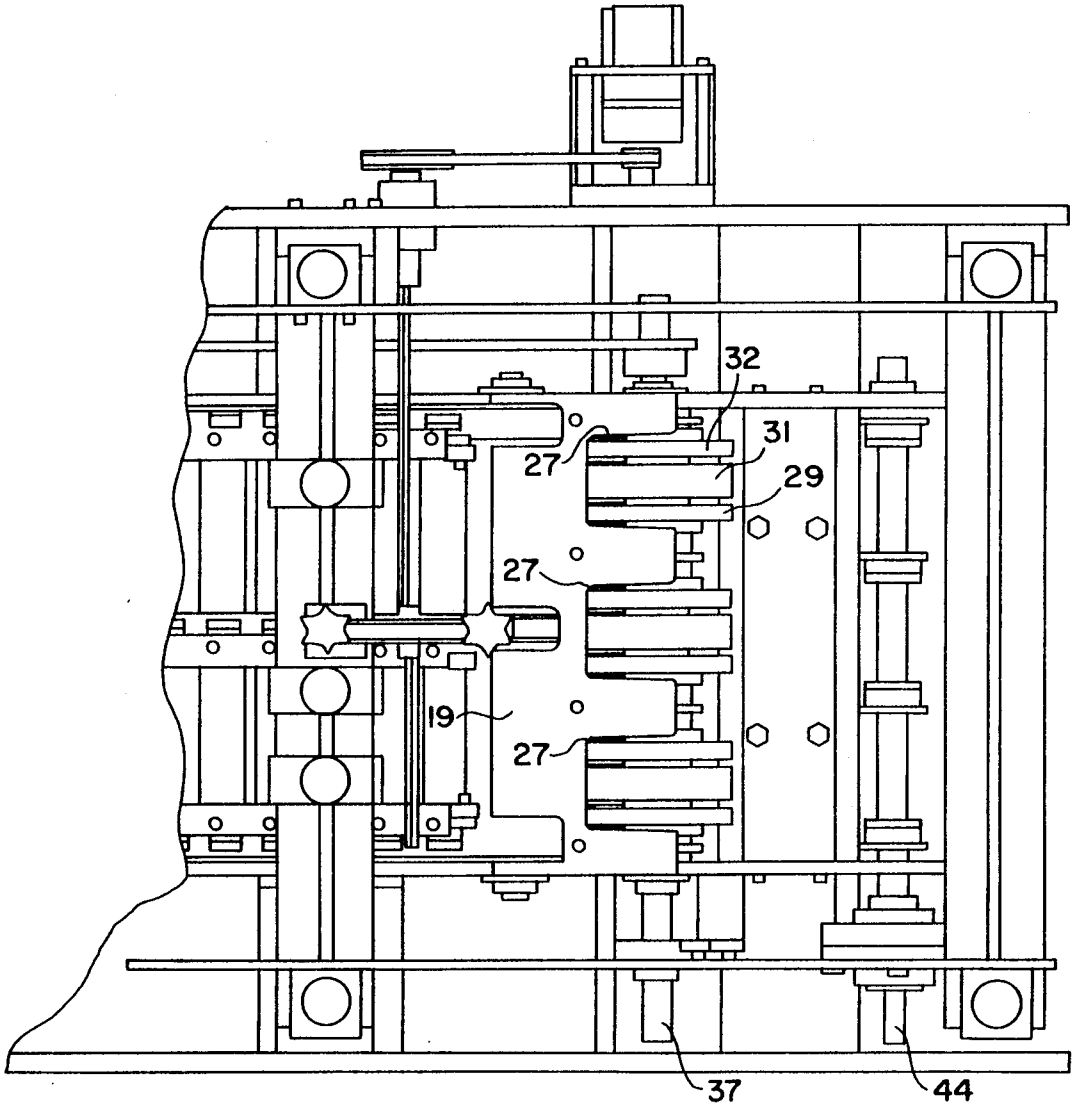
FIG. 8 is a plan view of an embodiment of the blank dispensing apparatus as seen in FIG. 3.

As seen in FIG. 2, dispensing apparatus 11 provides a stacking magazine having two retaining walls 15 and 17 and an angled support seat 19 for the proper positioning and retaining of carton blanks. As seen in FIG. 3, a stack of multiple carton blanks 21 supplied by pre-feeder 1 (not shown) is supported at an inclined angle with the bottom carton blank 23 engaging a multiple-wheeled roller 25 at a raised end distal from the lower end in close proximity to conveyor 9. The wheels of roller 25 traverses support seat 19 through roller guide slots 27 (best seen in FIG. 8) defined by support seat 19.

Figure 4:
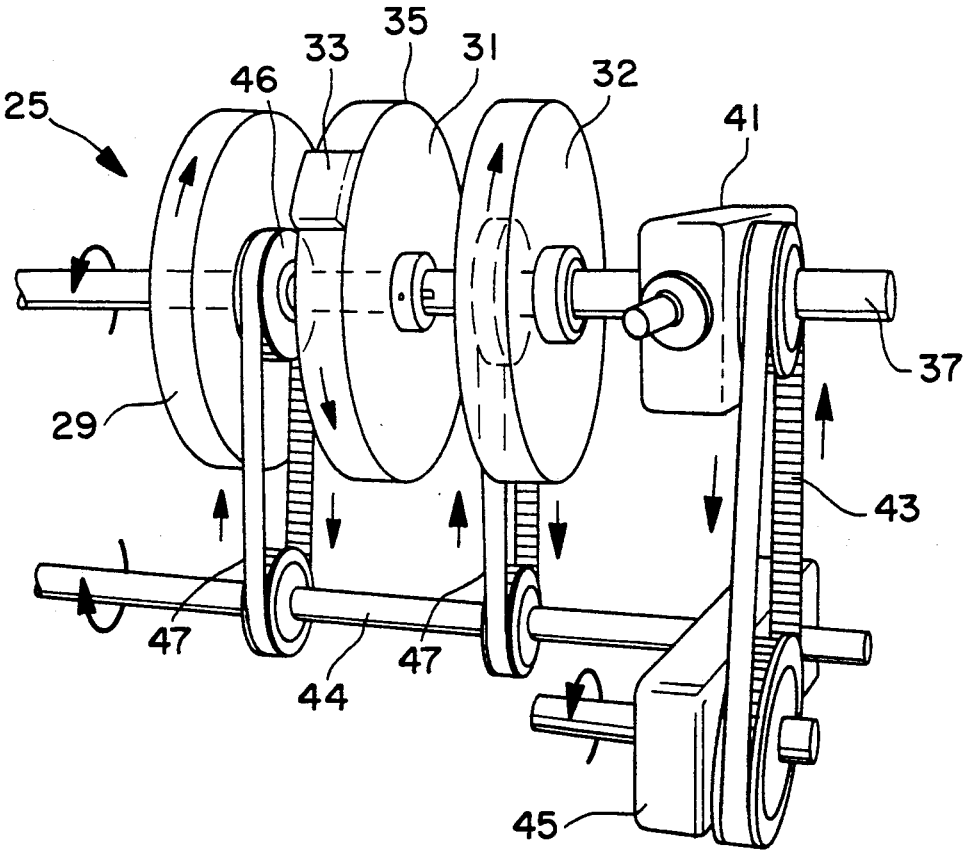
FIG. 4 is a perspective view of one embodiment of the multiple-wheeled, bidirectional roller viewed in the direction of line 4—4 of FIG. 3.
Figure 6:
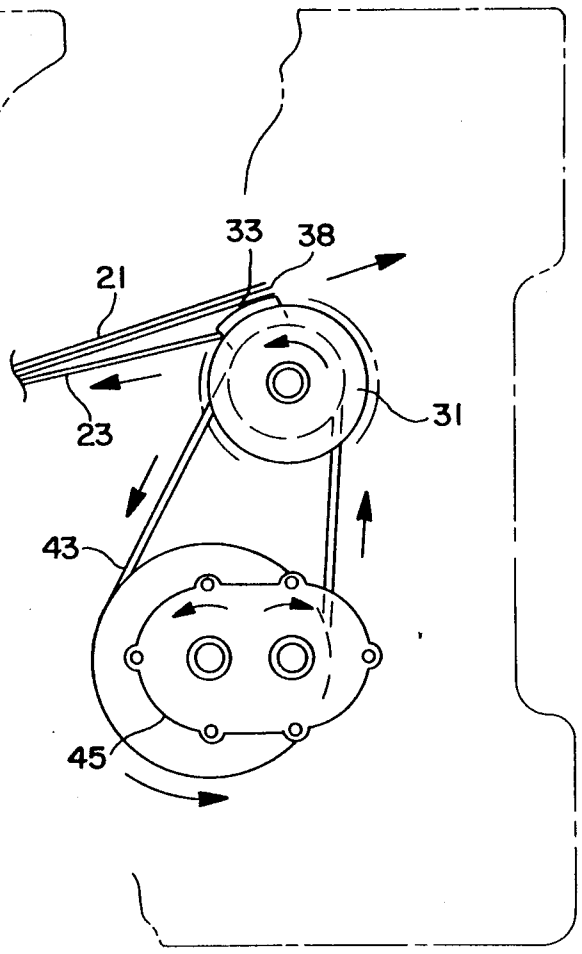
FIG. 6 is a side elevation similar to FIG. 5 illustrating one embodiment of the cleated wheel biasing means.
Figure 5:
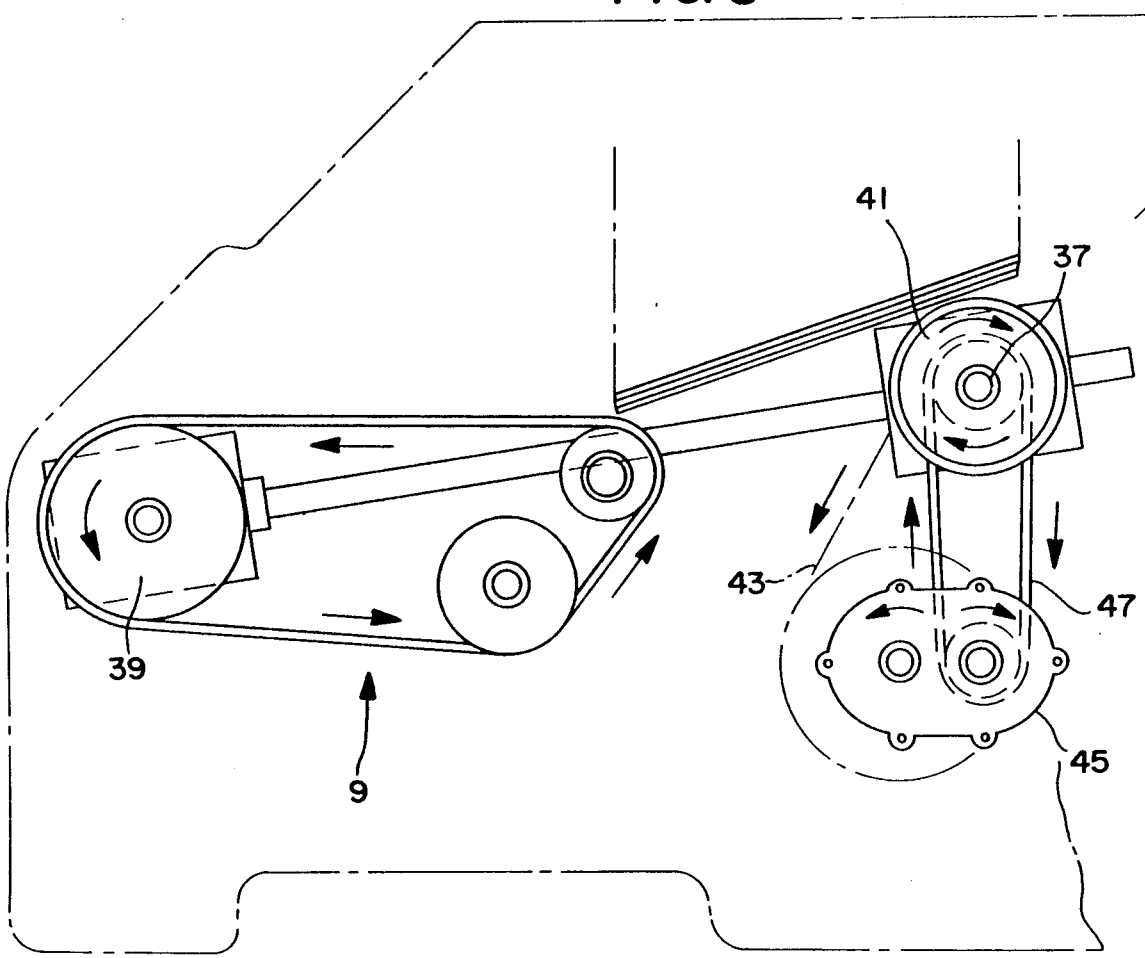
FIG. 5 is a side elevation view in partial phantom of the blank dispensing apparatus gear drive mechanisms.
Figure 7:
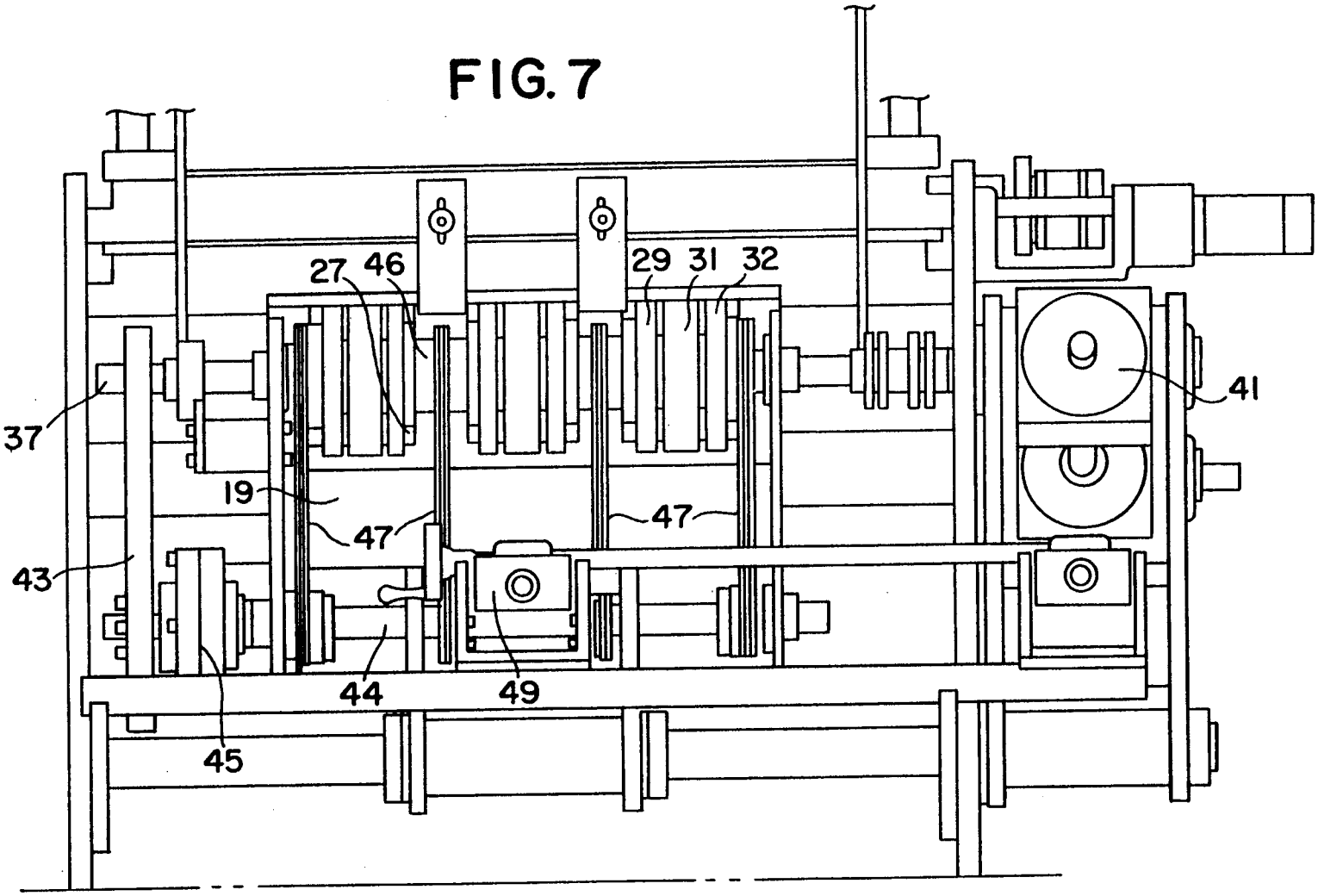
FIG. 7 is a rear perspective of an embodiment of the blank dispensing apparatus.

As further seen in FIGS. 4 and 7, roller 25 can define a set of three wheels; an inner cleated wheel 31 carrying cleat 33 and two exterior smooth surfaced wheels 29 and 32. Smooth wheels 29 and 32 should be of identical size while cleated wheel 31 should have a smaller diameter than wheels 29 and 32 so as not to engage the carton blank stock with its non-cleated surface. Wheels 29 and 32 of roller 25 are carried upon axle 37 in an independent fashion by hubs 46 such that wheels 29 and 32 are able to rotate in a clockwise direction (in reference to FIGS. 1 through 6) while wheel 31 can rotate in a counterclockwise direction.

It has been found that this arrangement of a three wheeled roller traversing a magazine support surface works best for supplying high speed conveyors with carton blanks. However, many variations are possible to accommodate various stock blank dimensions and properties.

As seen in FIG. 1, the speed of wheel 31 is preferably synchronized with the speed of the adjacent conveyor 9. A first 39 and a second 41, 90° or right angle gear box can be used to provide a synchronizing means for driving conveyor 7 and axle 37 of wheel 31, respectively. As seen in FIGS. 4 and 7, axle 37, in synchronization with conveyor 7, drives cleated wheel 31 and engages a first belt 43 which is used to drive a reverse rotation gear box 45. Gear box 45 in turn drives shaft 44 in the opposite direction than that of shaft 37. Belts 47 are then used to drive hubs 46 of wheels 29 and 32, thereby turning wheels 29 and 32 in the opposite direction of cleated wheel 31. While a three wheeled roller is shown in FIG. 4, the number, location and spacing of both the rollers and the wheels can be varied according to the user's needs. While FIG. 4 shows gear box 41 and reverse gear box 45 in vertical alignment, this positioning is illustrative only. As seen in FIG. 7, the respective gear means 41 and 45 can occupy opposite sides of apparatus 1.

Roller 25 and its associated drive belts, wheels and shafts are ideally designed so that they can be positioned at varying locations and heights along the length of support seat 19. Adjusting means 49, controlled by hand wheel 51, is provided to facilitate the positioning of roller 25. In this manner, roller 25 can accommodate a variety of different sized carton blank stock.

For many applications, it is preferred to position roller 25 so that cleat 33 of wheel 31 engages an edge 38 of a single piece of carton blank stock 23 as seen in FIG. 6. Under such circumstances, cleat 33 must be sufficiently thin so that edge 38 of only a single carton blank stock is engaged with each pass of the wheel. The thickness of the required cleat would naturally vary with the thickness of the carton blank stock. Adjusting means 49 and hand wheel 51 is able to precisely orient roller 25 and cleated wheel 31 for proper engagement of the cleat with edge 38 of the carton blank stock.

In another preferred embodiment best seen in FIG. 3, as wheel 31 rotates in a counterclockwise direction, cleat 33 engages a lower surface of the bottom carton blank 23 held in magazine 13. As a result, cleat 33 displaces in an upward direction the stack of carton blank stock while simultaneously biasing the bottom blank 23 toward conveyor 9. As cleat 33 disengages from bottom blank 23, the remaining supply of stock 21 held in magazine walls (not shown) is lowered with the next sequential carton blank now engaging the smooth surface of wheels 29 and 32 (best seen in reference to FIG. 4). The engaging forces supplied by wheels 29 and 32 to the bottom blank stock piece 23 counters the opposite force of belt 5 supplied by conveyor 9 and prevents the simultaneous feeding of two stock blanks to the adjacent conveyor 9. As a result, jamming, slippage, and machine down time is substantially reduced.

It is also possible to vary the height and length of cleat 33 which in turn can control the magnitude and duration of the biasing force. Further, cleat 33 can be designed to reversibly engage the rim of wheel 31. This arrangement simplifies maintenance and permits a variety of different sized and textured cleats to be employed to accommodate different textures and weights of the blank stock. Furthermore, it would be possible to supply a wheel carrying more than one cleat. This arrangement of a multiple cleated wheel would provide an additional means of synchronizing the cleated wheel speed to the speed of the adjacent conveyor 9.

The invention provides a continuous virtually trouble-free production rate of at least two hundred packages per minute. Furthermore, the rate of nearly seven hundred packages per minute may be maintained for shorter periods of time. This is in contrast with prior art machines which have had difficulty maintaining such a sustained production rate. Thus, it can be seen that a novel and useful apparatus and process for the feeding of carton blank stock to an adjacent conveyor has been provided.

Many variations of the above invention may be apparent to those skilled in the art from the reading of the description which is exemplary in nature. Such variations are embodied in the spirit and scope of this invention as measured by the following appended claims.

That which is claimed:

1. An apparatus for the supplying of flat carton blanks to an adjacent carton blank conveyor comprising:

a stacking magazine having a seat and side retaining means for positioning a supply of blank stock, said seat defining a roller guide slot in communication with an upper seat surface;

a roller carried below said stacking magazine in communication with said upper seat surface through said roller guide slot, said roller further comprising:

a first wheel having a uniform surface;

a second wheel adjacent to said first wheel and carrying a cleat upon an outer rim;

means for rotating said first wheel in a first direction and rotating said second wheel in a second direction counter to that of said first wheel;

wherein said cleat of said second wheel engages a first piece of blank stock through said roller guide slot, biasing said blank stock toward an adjacent carton blank conveyor while said first wheel applies an opposing securing force to a second piece of blank stock.

2. The apparatus according to claim 1 wherein said second wheel is carried between said first wheel and a third wheel, said third wheel having a radius and a surface substantially similar to said first wheel.

3. The apparatus according to claim 1 whereby said means for rotating said first and said second wheel is a reverse rotation gear box.

4. The apparatus according to claim 1 wherein said carton blank stock biasing and securing means is provided by a plurality of wheels traversing a plurality of guide slots.

5. The apparatus according to claim 1 wherein said means for rotating said cleated wheel is by synchronous means responsive to said carton blank conveyor.

6. The process of feeding carton blank stock to an adjacent conveyor comprising the steps of:

loading a magazine having retaining means with a supply of stacked carton blank stock;

positioning said carton blank stock so that one end of said stack is supported by a multiple wheeled roller;

raising said carton blank stock by the rotation of a cleated wheel of said wheeled roller;

biasing a single piece of carton blank stock of the bottom of said stack to an adjacent conveyor by the further engagement of said cleated wheel to said carton blank stock piece;

lowering said remaining carton blank stock to said multiple wheeled roller;

engaging a sequential bottom piece of said carton blank stock with a second wheel of said roller, said second wheel rotating in a direction opposite of said cleated wheel;

securing said sequential carton blank piece with a frictional force supplied by said second wheel;

repeating the above steps.

7. The process according to claim 6 wherein said multiple wheeled roller is comprised of a cleated wheel carried between a pair of smooth surfaced wheels.

8. The process of feeding carton blank stock to an adjacent conveyor comprising the steps of:

loading a magazine having retaining means with a supply of stacked carton blank stock;

positioning said carton blank stock so that one end of said stack is supported by a multiple wheeled roller;

engaging an edge portion of a lowermost single carton blank stock by a cleat of a cleated wheel of said wheeled roller;

biasing said single piece of carton blank stock to an adjacent conveyor by the further engagement of said cleated wheel to said carton blank stock piece;

lowering said remaining carton blank stock to said multiple wheeled roller;

engaging a sequential bottom piece of said carton blank stock with a second wheel of said roller, said second wheel rotating in a direction opposite of said cleated wheel;

securing said sequential carton blank piece with a frictional force supplied by said second wheel;

repeating the above steps.

9. The process according to claim 8 wherein said multiple wheel roller is comprised of a cleated wheel carried between a pair of smooth surfaced wheels.

* * * * *